United States Patent [19]

Bianco et al.

[11] 4,245,578

[45] Jan. 20, 1981

[54] PROCESS AND APPARATUS FOR HANDLING A DIVING MACHINE

[75] Inventors: Vincent Bianco; Paul D. Grognu, both of Marseilles; Henri Chetoni, Allauch, all of France

[73] Assignee: Compagnie Maritime d'Expertises, Marseilles, France

[21] Appl. No.: 934,034

[22] Filed: Aug. 16, 1978

[30] Foreign Application Priority Data

Sep. 2, 1977 [FR] France ..... 77 27518

[51] Int. Cl.[3] ..... B63G 8/00

[52] U.S. Cl. ..... 114/312; 114/51

[58] Field of Search ..... 114/312, 315, 322, 51; 166/356; 405/185; 9/41; 254/172

[56] References Cited

U.S. PATENT DOCUMENTS 3,641,961 2/1972 Howard ..... 405/185

3,996,870 12/1976 Haavie ..... 114/312

FOREIGN PATENT DOCUMENTS 485912 1/1973 U.S.S.R. ..... 405/185

*Primary Examiner*—Edward R. Kazenske

*Assistant Examiner*—Jesus D. Sotelo

*Attorney, Agent, or Firm*—Lewis H. Eslinger

[57] ABSTRACT

Apparatus for handling a submersible device, such as a diving bell, includes a winch mounted on a support structure and having a suspension cable with a free end at which the submersible device is suspended, a guide structure fixed to the support structure and having two guidance ramps, each having a portion thereof extending below a water surface, a traveller having two parallel side members with a guidance device thereon which slidably cooperates with the two guidance ramps, a pulley back including two upper pulleys secured to the guide structure and a movable lower pulley fixed to the traveller with the suspension cable passing over the upper and lower pulleys so as to form n strands, and a locking device for releasably connecting the submersible device to the traveller. The submersible device is lowered into the water with the traveller at a slow speed equal to the unwinding speed of the cable from the winch divided by the number of strands n formed by the pulley block until the submersible device completely passes the air-water interface and is then disconnected from the traveller and lowered further into the water at the cable unwinding speed so as to eliminate the effect of the pulley block. The reverse operation is used for raising the submersible device out of the water.

8 Claims, 8 Drawing Figures

PROCESS AND APPARATUS FOR HANDLING A DIVING MACHINE

BACKGROUND OF THE INVENTION

The present invention relates to a process and apparatus for handling a submerged machine or apparatus, which can for example be a diving bell, a submarine or any other load, whose weight in air is high compared with the apparent weight in the water.

The technical field of the invention is that of handling processes and apparatus used for working under water.

The difficulties encountered in this field in connection with the launching, floating and recovery from a surface support of a submarine apparatus due to the pounding resulting from the swell when said apparatus passes into the so-called "water interface zone" are well known.

It is also known that for a submarine apparatus to be kept submerged whilst being connected to a surface support by a suspension cable special measures must be taken or a so-called "anti-pounding" apparatus must be provided to protect the submarine apparatus from the surges caused by the movements of the surface support under the action of the swell.

Processes and apparatus have already been realised for the passage through the water interface. A known process for the recovery of the diving apparatus comprises pulling it out of the water at a speed greater than that of the waves during the passage through the zone subject to the swell.

Lifting gear has also been developed to permit such operations to be performed.

Furthermore, numerous anti-pounding apparatus have been developed to solve this problem. Such apparatus consisting of improved winches with constant cable tension and hydraulic compensation apparatus or the like are relatively complex and although the results obtained are good, they require careful supervision and maintenance to bring about this satisfactory operation.

BRIEF SUMMARY OF THE INVENTION

The present invention aims at reducing the power of the handling apparatus and the tension in the suspension cable during the handling of the submarine machine out of the water when its weight is maximum, accompanied by no reduction in the speed of raising or lowering the machine when it is entirely submerged.

A further aim of the invention is to possibly utilize the device used in achieving the above first-mentioned aim to reduce the excess tensions which could occur in the suspension cable under the action of the swell when the machine is submerged.

The object of the present invention is handling processes for a submarine apparatus or machine from a surface support by means of a handling apparatus, for example a winch or any equivalent apparatus, which is located on the surface support and which is equipped with a suspension cable, on whose free end the machine is suspended.

During the launching of the machine, the first aim is realised by a process comprising the following stages:

(a) with the machine out of the water it is connected to a guidance means and the assembly formed by said guidance means and said machine is connected to a carrying structure forming part of the surface support by means of a pulley block with n strands;

(b) the assembly is lowered until the machine is submerged at a slow speed equal to the cable unwinding speed V divided by the number of strands n;

(c) the machine is detached from the guidance means and the descent of the latter is stopped in such a way that the pulley block is eliminated and the machine is handled underwater at a speed equal to the cable unwinding speed V.

During the raising out of the water, the first aim is achieved by a process comprising the following stages:

(a) the machine is raised at speed V until it strikes against the guidance means which has been kept submerged;

(b) the machine is connected to the guidance means which reconstitutes the pulley block;

(c) the assembly constituted by the guidance means and the machine is raised out of the water at slow speed V/n.

During the period when the machine is submerged, and no matter whether it is stationary or moving, the second aim is realised by leaving the guidance means free to rise again so that it reduces excess tension in the suspension cable.

An apparatus for realising the invention comprises:

(a) a handling apparatus located on the surface support and equipped with a suspension cable on whose free end is suspended the machine;

(b) a structure fixed to the surface support and extending below the surface of the water;

(c) a slider or traveller comprising guidance means cooperating with at least one guidance ramp carried by said structure;

(d) a pulley block with n strands comprising at least one fixed upper pulley and at least one movable lower pulley over which passes the suspension cable and the upper pulleys are supported by the said structure, whilst the lower pulleys are fixed to the same traveller;

(e) and means for temporarily connecting the submarine machine and traveller when said machine is at least partly out of the water, followed by the disconnection thereof.

According to a preferred embodiment, the structure comprises at least one horizontal transverse beam whose upper part is located out of the water and at least two guidance ramps for the traveller extending downwards from said beam and which pass into the water.

Preferably, the traveller comprises a chassis in the form of a gantry havikng an upper horizontal cross-member and two parallel lateral posts carrying the guidance members cooperating with the ramps of the structure.

In the case where the traveller serves to limit the excess tensions in the cable during the time that the machine is submerged, the ramps of the structure have abutments on which the traveller is supported, thereby limiting the downward travel thereof, whilst permitting it to rise freely again if the sum of the tensions in the $n-1$ strands of the cable passing over the pulleys attached to the traveller exceed the apparent weight of the traveller. In this case, the apparent weight of the traveller in the water exceeds the product of the apparent weight of the machine by $n-1$.

As a variant, the ramps of the structure may also carry a submerged ballast resting on abutments in such a way that it can slide upwards and in this case the traveller has means for temporarily connecting it to said ballast during the time when the machine is submerged.

In this case, it is the apparent weight of the ballast, plus the apparent weight of the traveller which is equal to n−1 times the apparent weight of the submerged machine.

According to another variant, when the traveller is not to be used for reducing the excess tensions in the cable when the machine is submerged, the traveller has means, for example bolts, for temporarily fixing it to the ramps whilst maintaining it submerged during the time when the machine is submerged.

The result of the invention is the handling of a submarine or apparatus from a surface support, whilst reducing the power of the handling apparatus and the tensions in the cable during the handling operations out of the water, without reducing the displacement speed of the machine in the water.

When the machine is out of the water, its weight is high. Due to the pulley block with n strands, the necessary power of the lifting tackle and the tension in the cable is essentially divided by n, whilst remembering that it is necessary to add the weight of the traveller to that of the machine, although the traveller weight is much smaller than that of the machine. The handling speed is also divided by n, which would make the operations very long if the pulley block was retained during the period when the machine is submerged. This disadvantage is obviated due to the fact that said pulley block is eliminated when the machine is submerged. Once the pulley block has been eliminated, the machine descends at the cable unwinding speed V. At this time, only the apparent weight of the machine, which is much smaller than its true weight, is exerted on the cable. If it was desired that the tension in the cable is substantially the same when the machine is out of the water and its true weight is P and when the machine is submerged and its apparent weight is Pa (much smaller than P), the true weight of the traveller C must be such that $(P+C)/Pa=n$.

If it is also desired to use the traveller for producing the excess tension which may occur in the cable under the action of the swell during the period when the machine is submerged, it is necessary for the traveller (or the assembly formed by the traveller and a ballast) to be placed on abutments, whereby it can slide upwards, whilst the apparent weight of the traveller (or the assembly of the traveller and the ballast) to be slightly higher than n−1 times the apparent weight of the machine. In this case, when there is no excess tension, the sum of the tensions in the n−1 strands of the cable passing over the pulleys attached to the traveller is less than the apparent weight of the traveller which continues to be supported on the abutments. If excess tensions appear in the cable under the action of the swell or too great an acceleration during the raising of the machine when the sum of the tensions in the n−1 strands of the cable attached to the traveller exceeds the apparent weight of the latter, said traveller rises which limits the excess tensions and reduces the amplitude of the oscillations of the machine suspended on the cable, despite the oscillations of the carrying structure.

The travel of the traveller must be calculated as a function of parameters which are easy to establish as a function of the element on which the surface support floats.

During the raising of the machine and as soon as its inertia has been overcome (mass of the machine+drag) on starting up the winch the values are inverted and they again become what they were at the time of descent when the weight of the traveller in the water exceeds n−1 times Pa (weight of the machine in the water) and the traveller reassumes its position supported on the low abutments.

It is pointed out that the apparatus according to the invention is fixed to the surface support either overhanging from the side of the ship, or in a shaft.

BRIEF DESCRIPTION OF THE DRAWINGS

The invention is described in greater detail hereinafter relative to preferred embodiments and with reference to the attached drawings, wherein show.

DETAILED DESCRIPTION OF THE PREFERRED EMBODIMENTS

The process according to the invention of the handling of a submarine machine or apparatus, for example a diving bell, comprises effecting the launching, the submerging of the machine, its maintenance in the submerged position at the fixed point and its raising to the surface without the tension in the suspension cable varying significantly between the stages of handling the machine out of the water and handling it in the water.

In per se known manner, the machine is fixed to a cable, whose winding or unwinding is brought about by a winch disposed on the ship or any other equivalent handling apparatus equipped with a cable having a winding/unwinding speed V.

At the time of submergence, the machine is guided by associating it with a guidance means having a pulley block, which will be described in greater detail hereinafter.

Figure 6:
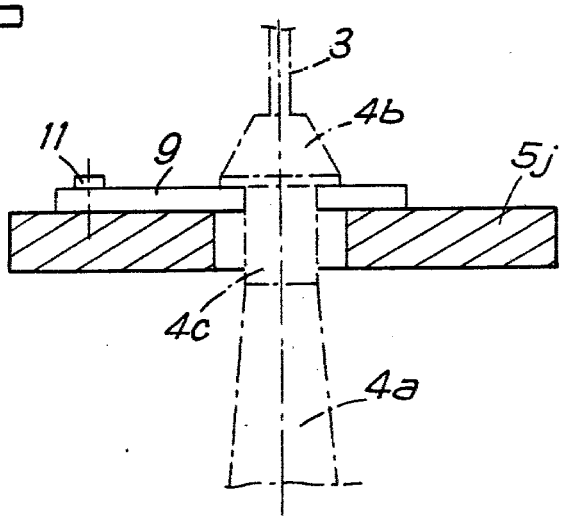
FIG. 6 a view in elevation and in section along the line VI—VI of FIG. 5.
Figure 5:
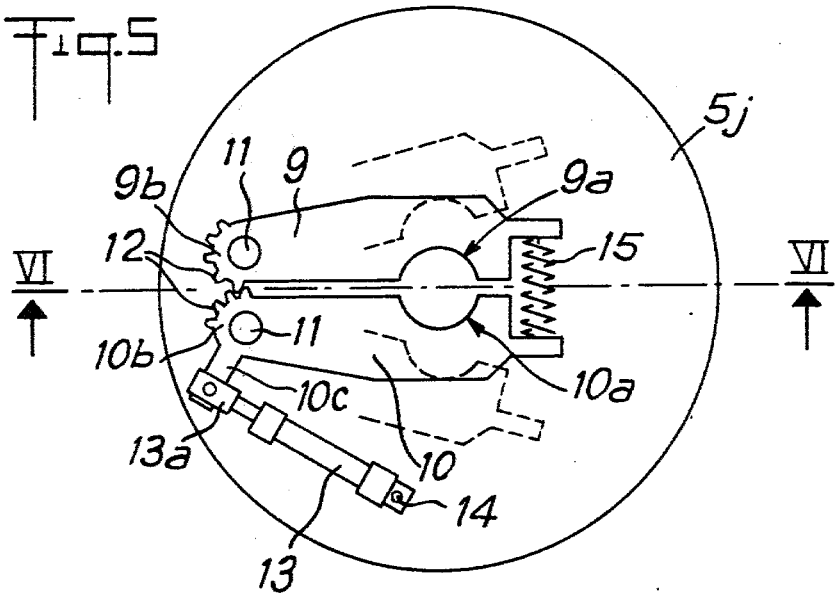
FIG. 5 a plan view of a machine locking device carried by the traveller.

The term "associate" is understood to extend protection to all means permitting the connection of the guidance means and the machine, for example of the type defined in FIGS. 5 and 6 or other means such as those shown diagrammatically in FIGS. 1 to 4 according to which the machine cooperates with the guidance means with the aid of a male member, said machine bearing on the guidance means via shock absorbers. These various means and devices will also be described in greater detail hereinafter.

As the traveller is located in a pulley block, the descent takes place at low speed (V/number of strands of pulley block) and the guidance means/diving machine assembly traverses the interface zone which is subject to the swell without there being any damage as a result of the swell. On passing beyond the water interface, the descent of the guidance means is stopped by making it bear against abutments located in the submerged lower end portion. The machine is then disconnected from the said means in order to continue its descent towards the point where work is to be carried out. Disconnection is brought about either by controlling the unlocking of the device optionally provided on the guidance means or by merely permitting the suspension cable to unwind.

In view of its above-mentioned weight and its position whereby it is supported on the abutments, the guidance means behaves in the manner of a return pulley and the speed of descent of the machine increases in proportion to the number of strands of the pulley block. At this time, the speed of the machine is equal to the nominal speed V of the winch.

When the machine has reached the desired depth, the winch is stopped. A length of cable is then unwound. As the machine remains submerged at a fixed point, it is clear then that under the action of the rocking of the ship, the distance between the machine and the final pulley of the pulley block (i.e. the strand of the cable fixed to the machine and which is wound round the pulley is perpendicular to the latter) is subject to variations of length.

If under the action of the pounding due to the swell, the tension in the cable, which is equal to Pa+ mass of machine x acceleration + drag in water, exceeds the weight of the guidance means in the water divided by n−1, the latter is then subject to altitutde variations by being stressed by the suspension cable of the machine whose part which extends from the final pulley which is perpendicular to the latter up to the winch is shortened when said distance increases during the upward movement of the ship and increases to return to its initial length when the ship moves downwards. Thus, the guidance means acts as an anti-pounding device. The raising of the machine is controlled and as soon as its inertia is overcome by starting the winch the weight in the water of the guidance means again exceeds n−1 times that of the machine in the water. The guidance means then reassumes its submerged position bearing on the abutments. Thus, the machine is raised at the nominal speed of the handling winch. At this speed, it encounters the guidance means and is associated therewith (or is locked thereto) to continue the raising of the guidance means/machine at slow speed (V/number of strands of pulley block) until it passes through the water interface and reaches the arrival point out of the water.

Reference will now be made to the attached drawings and more particularly to FIGS. 1 to 4 which diagrammatically illustrate an embodiment of the apparatus according to the invention for realising the same process and for the application of various stages of the latter.

Such an apparatus comprises a winch 1 fixed to a surface support 2, whereof only the floor supporting the winch is shown in the drawings. A cable 3 is wound round the drum of the winch 1 and its free end 3*a* is fixed to a diving bell or machine 4. This cable may be an ordinary suspension cable, but may also be an umbilical, whose construction makes it possible to resist pulling.

Figure 1:
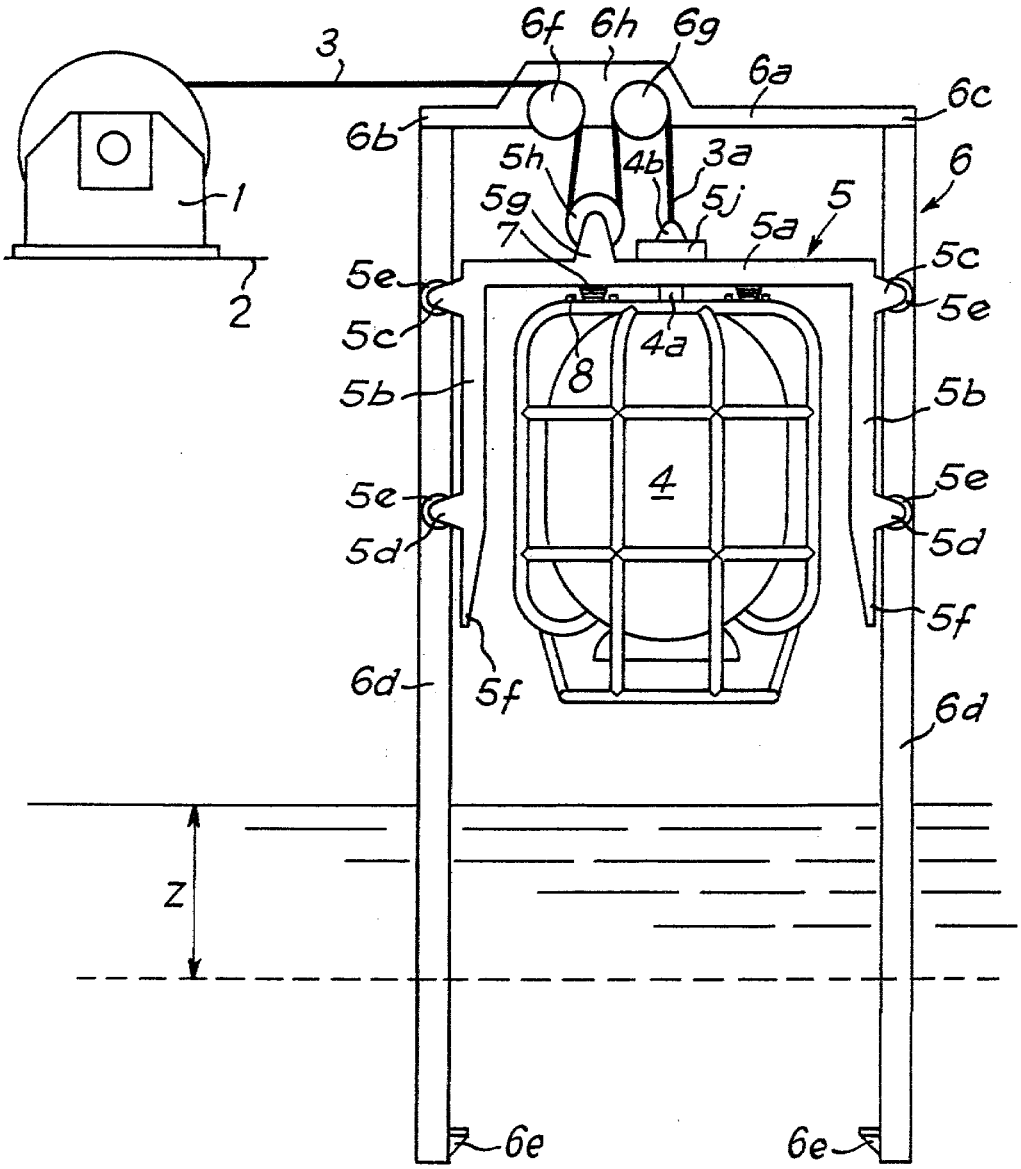
FIG. 1 a diagrammatic view of an apparatus according to the invention in elevation and illustrating one stage of the process at the time when the machine is in its starting/finishing position.
Figure 2:
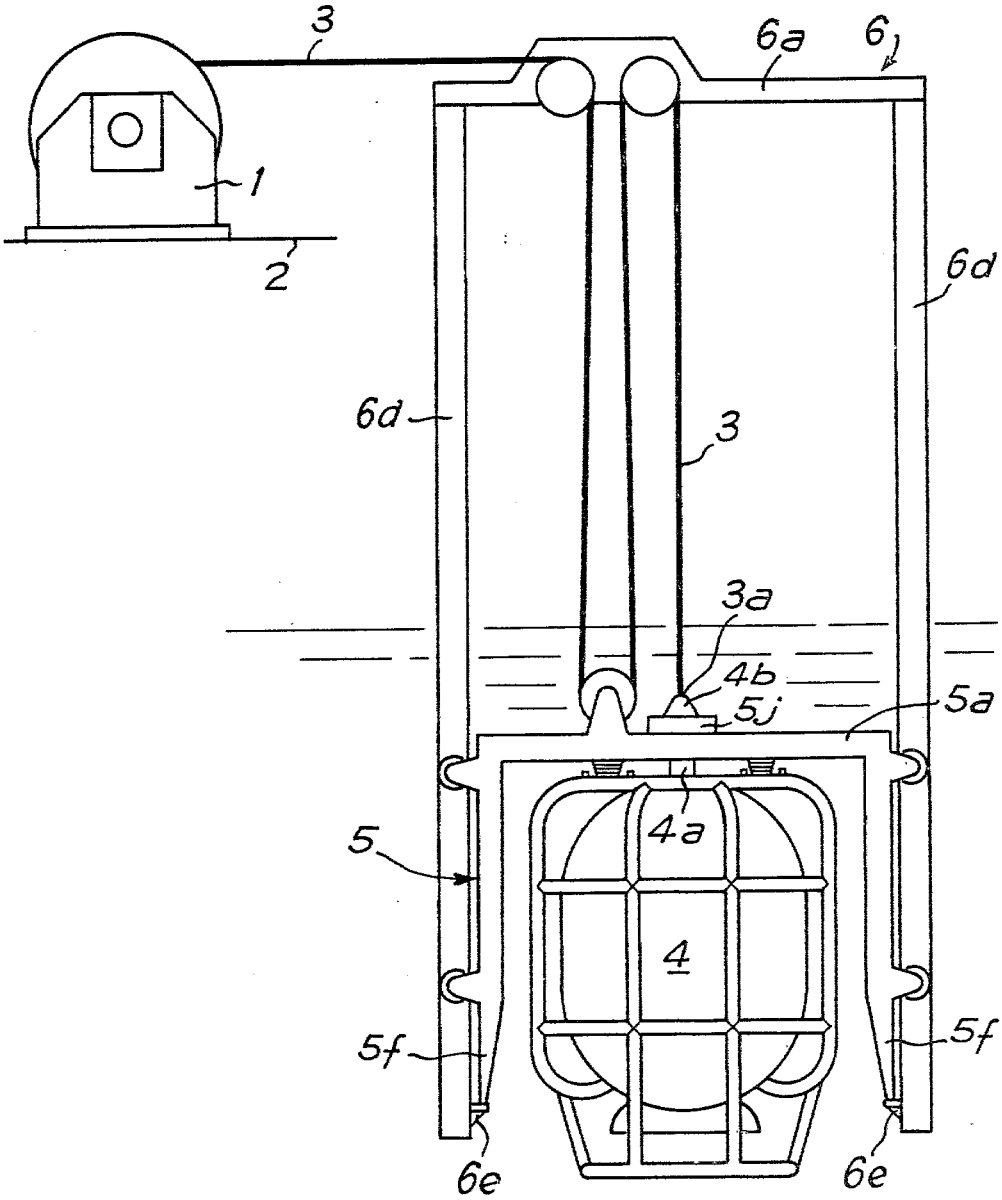
FIG. 2 a diagrammatic view in elevation of the apparatus of FIG. 1 illustrating other stages of the process at the time when the traveller/machine assembly is supported on abutments of the structure during the raising or lowering of the machine.
Figure 3:
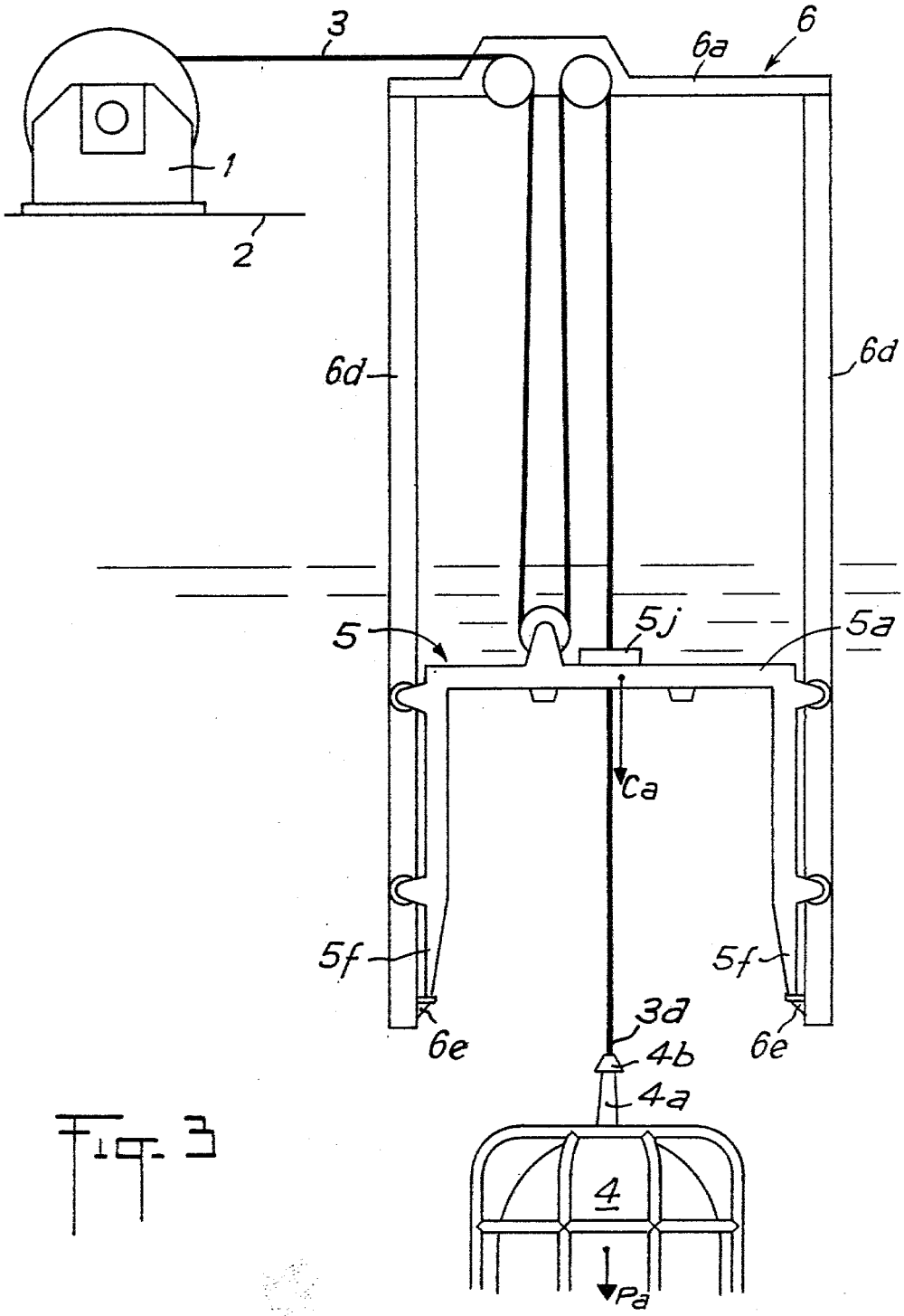
FIG. 3 a diagrammatic view in elevation of the apparatus of FIG. 1 illustrating other stages of the process at the time when the traveller is supported on abutments of the structure and when the machine is either disconnected from the traveller and continues its descent at the nominal speed of the winch, or the machine is rising again at said speed to be once again supported on the traveller.
Figure 4:
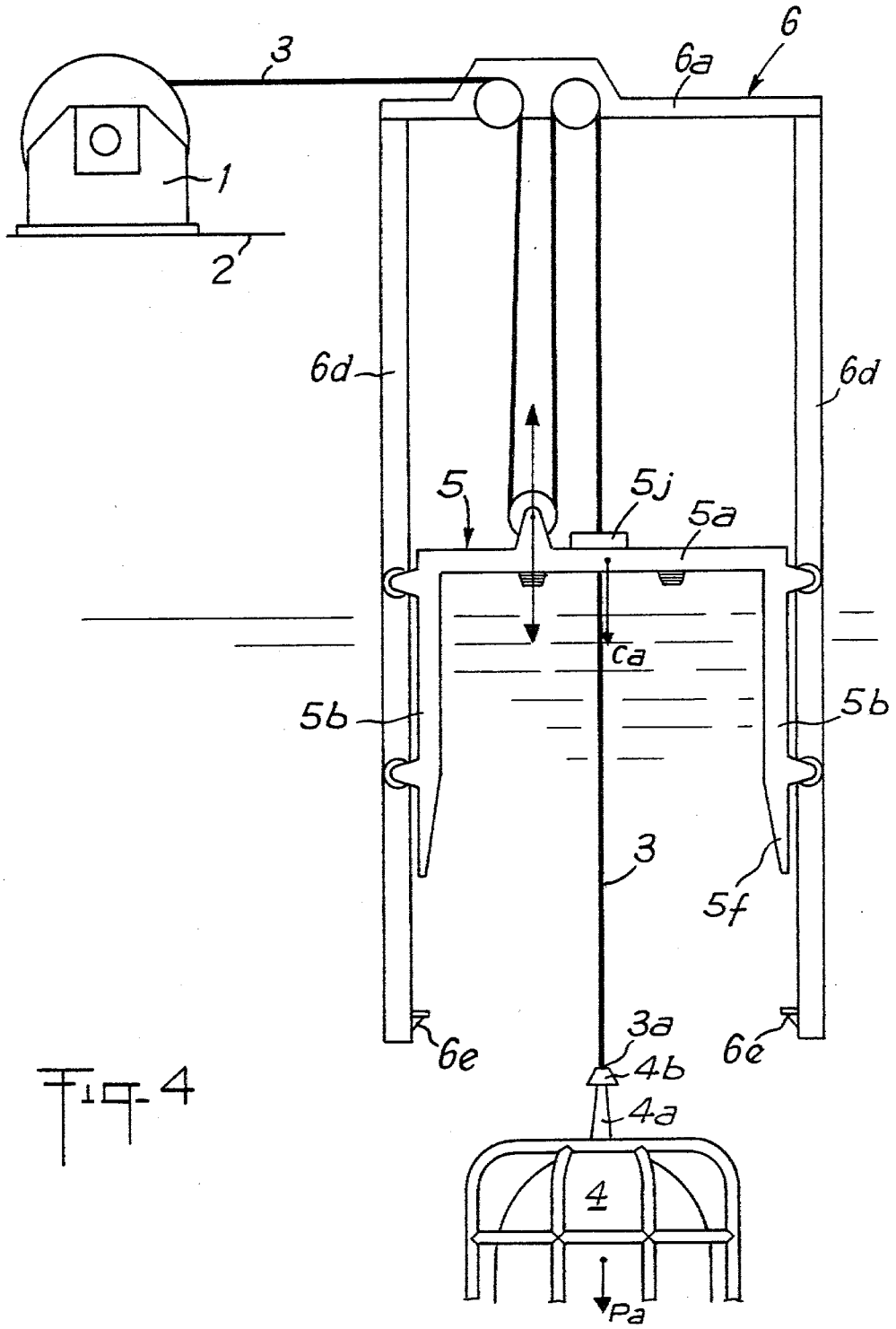
FIG. 4 a diagrammatic view in elevation of the apparatus of FIG. 1 illustrating another stage of the process at the time when the machine is at a fixed submerged point and when the traveller acts as an anti-pounding device.

As can be seen in FIGS. 1 and 2, the machine is associated with a guidance means comprising a slider or traveller 5 and a structure 6. This structure is fixed either to the outside of the side of the carrying ship or to a shaft located in the centre of the ship and comprises a transverse beam 6*a* which is substantially horizontal and parallel to the plane of the water and, fixed to its free end 6*b*/6*c* guidance ramp 6*d* perpendicular to beam 6*a* and correlatively parallel to one another. The length of ramp 6 is such that they penetrate the water in such a way that they pass beyond the critial interface zone Z which is subject to the swell. The function of ramp 6 is to cooperate with the traveller 5 with a view to the guidance thereof. The traveller 5 comprises a chassis 5*a* parallel to beam 6*a* and extending approximately over the length separating ramps 6*d* and two side-members 5*b* located at the ends of chassis 5*a* and extending downwards in a position parallel to ramps 6*d* and in close proximity to the latter. As can be seen in the drawings, the traveller has a U-shaped profile and surrounds the machine. However, this configuration is not limitative. The side-members 5*b* include outwardly directed yokes 5*c* and 5*d* which extend toward adjacent ramps 6*d* and which are co-planar, that is, which are aligned in the plane of the paper. Mounted to yokes 5*c* and 5*d* in a freely rotatable manner are rollers 5*e* which may have a groove to cooperate with the rails in the case where the ramps constitute such members, or if they have no groove they cooperate with U-irons, as illustrating very diagrammatically in the drawings.

In the lower part of the side-members 5*b* traveller 5 has buffers 5*f* which bear on shoulders 6*e* in the extreme lower part of guidance ramps 6*d*. The shoulders are in a same plane parallel to beam 6*a* and are directed towards one another within the structure 6.

In the upper part of chassis 5*a*, traveller 5 also has a yoke 5*g* in which is mounted in rotatable manner a grooved pulley 5*h*.

The structure 6 also has two pulleys 6*f*/6*g* mounted so as to rotate freely in a yoke 6*h*. Pulley 6*g* is positioned in such a way that the strand of cable 3 connecting the machine 4 is perpendicular to the latter. As can be gathered from the drawings, the assembly of pulleys 5*h*, 6*f*,6*g* constitutes a pulley block around which is wound cable 3. It is pointed out that the pulley blocks may be constituted by one or more pulleys.

The chassis 5*a* of traveller 5 has in its centre a female centering device 5*j* for machine 4 and which serves to cooperate with a male member 4*a* disposed in the longitudinal axis and in the upper part of said machine.

The end 3*a* of the cable is fixed to the centering member 4*a* which has at its end a protruberance or head 4*b* in the form of a cone, whose generating lines diverge downwards. The function of this conical head is to facilitate the cooperation of male member 4*a* and female member 5*j* during the bringing together of machine 4 and traveller 5.

According to one embodiment for the association of the diving machine and the traveller, the latter rests by its own weight on the machine, whose suspension cable 3 supports the assembly. Frustum-shaped shock absorbing studs 7 are distributed over a circumference concentric to the theoretical axis on which move the machine and the traveller and are fixed to the latter at the periphery of member 4 and of cable 3. To prevent the shifting of machine 4 relative to traveller 5, said studs 7 cooperate with at least one recess 8 fixed to the machine. According to one embodiment, these recesses are shaped like a frustum-like cup and in this case there are the same number of cups as there are studs 7. Alternatively, the shape is that of an annular opening with a trapezoidal cross-section in which engage the studs 7.

It is possible to provide traveller 5 with a locking device disposed on part 5*j* of chassis 5*a*. Such a device which brings about the locking of the machine is illustrated in FIGS. 5 and 6. It comprises two jaws 9, 10 which move in a plane which is parallel and in proximity to the female member 5*j* and are articulated about two axes 11 perpendicular to said member 5*j* and relatively remote from the centre 0 of the latter. Each of these jaws has a semi-circular cutout of the same radius 9*a*, 10*a* for cooperating with the cylindrical part 4*c* of male member 4, which forms a constriction below the frustum-shaped head 4*b*. These jaws are simultaneously articulated by means of a coupling system 12 to curved racks 9*b*, 10*b*.

Jaw 10 has an arm 10*c* to which is articulated the movable rod 13*a* of a double acting hydraulic jack 13, whose body is mounted in articulated manner about an axis 14 perpendicular to the female member 5*j*. Jack 13 moves in the plane of jaws 9, 10, which are joined at their free ends by an elastic means 15, for example a spring.

The jaws 9, 10 are shown in the open position by dotted lines in FIG. 5.

Figure 7:
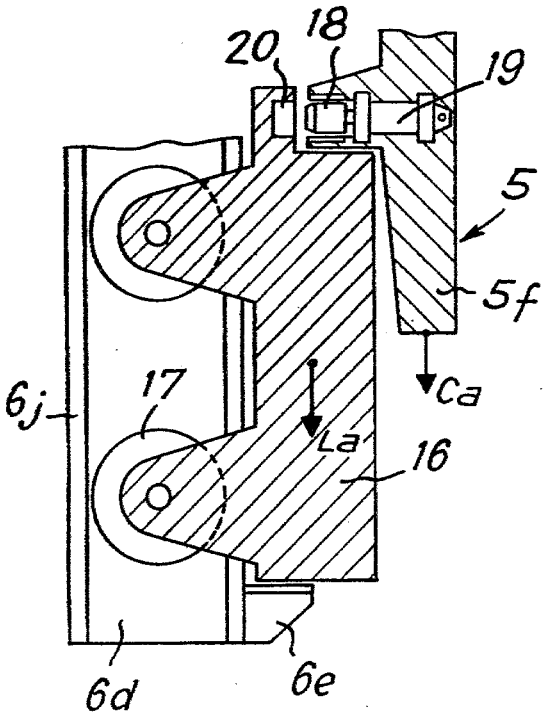
FIGS. 7 and 8 constructional variants.

FIG. 7 represents a constructional variant.

In the case where traveller 5 is used to limit excess tensions in the suspension cable, the apparent weight of traveller Ca must exceed n−1 times the apparent weight Pa of the machine. When the apparent weight Pa of the machine is high, this makes it necessary to use a traveller having a high apparent weight Ca and therefore a true weight C which also is high and when the machine is out of the water, the true weight C of the traveller is added to the true weight P of the machine. To obviate this disadvantage, when using the traveller to reduce excess tensions, a ballast 16 or several ballasts are used and these remain submerged, being located on shoulders 6*e* fixed to the lower end of guidance ramp 6*d* forming part of the fixed structure 6. These ballasts can slide freely upwards. For example, they are equipped with rollers 17 which roll along rails 6*j* forming part of ramps 6*d*.

Traveller 15 has means permitting the temporary connection thereof with the said ballasts. These means are constituted for example by bolts 18 which are manipulated by a small jack 19 and which engage in recesses 20, hollowed out of the ballasts in the manner indicated by the arrow. These bolts may be replaced by any other equivalent assembly means.

In this case, the apparent weight La of the ballasts, plus the apparent weight Ca of the traveller exceeds n−1 times the apparent weight Pa of the machine. Only traveller 5 passes out of the water with the machine, so that the true weight of traveller 5 is added to the true weight of the machine, when out of the water.

FIG. 7 shows on a larger scale, the lower end of a ramp 60 carrying a shoulder 6*e*, part of ballast 16 and the lower end of one of the buffers 5*f* of traveller 5 carrying a bolt 18.

Figure 8:
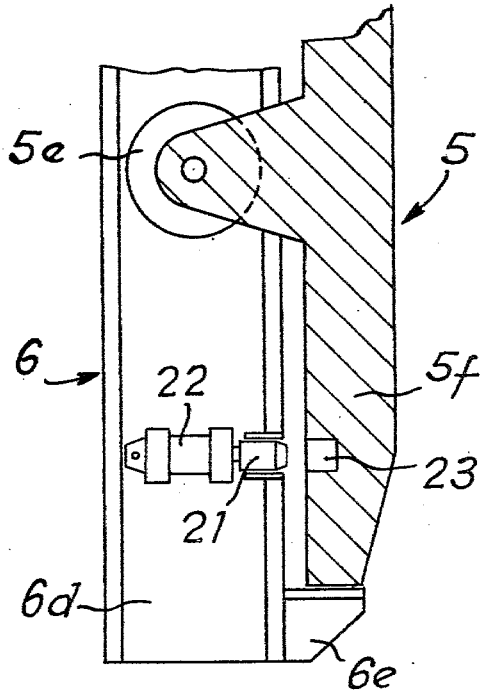

FIG. 8 shows another variant corresponding to the case where the traveller is not used to reduce excess tension in the cable when the machine is submerged. In this case, traveller 5 is temporarily fixed to the fixed structure 6, when disengaged from machine 4, so that it only serves as an attachment point for the lower pulleys 5*h*, which then merely serve as return pulleys for the suspension cable.

In this case, the traveller need only have a minimum weight, so that it can be made considerably lighter. The sole function of the traveller is to guide the machine when it is passing through the interface and makes it possible to provide a temporary pulley block, which is eliminated after the machine has been submerged.

FIG. 8 shows the lower end of a buffer 5*f* of traveller 5 equipped with rollers 5*e*. It shows the lower end of a ramp 6*d* of fixed structure 6, along which roll the rollers 5*e*. This end 6*d* carries a shoulder 6*e* against which the traveller abuts.

FIG. 8 also shows an embodiment of a means for temporarily connecting the traveller 5 to the fixed structure. This means is constituted by a bolt 21, actuated by a small jack 22 which penetrates, in the direction of the arrow, a recess 23 hollowed out of traveller 5. During the descent of the machine, fixed to the traveller, jack 22 is actuated when the traveller is placed on shoulder 6*e* and the machine is disconnected from the traveller. During the raising of the machine and when it abuts against the traveller, it is connected to the traveller and jack 22 is actuated to free bolt 21.

What is claimed is:

1. Apparatus for handling a submersible device comprising:

a control device mounted on a support structure and including a suspension cable having a free end at which said submersible device is suspended;

a guide structure fixed to the support structure with at least a portion of said guide structure extending below the surface of a liquid body, said guide structure having at least one guidance ramp;

a traveller including guidance means for slidably cooperating with said at least one guidance ramp;

a pulley block including at least one fixed upper pulley secured to said guide structure and at least one movable lower pulley fixed to the traveller, said suspension cable passing over said at least one fixed upper pulley and said at least one movable lower pulley so as to form n number of strands; and means for temporarily connecting the submersible device to said traveller when at least a portion of said submersible device extends out of the liquid body.

2. An apparatus according to claim 1, wherein the guide structure includes at least one horizontal transverse beam which is positioned out of the liquid body and at least two guidance ramps for cooperating with the traveller, said at least two guidance ramps extending from said beam into the liquid body.

3. An apparatus according to claim 2, wherein the traveller includes a chassis in the form of a gantry, said chassis having an upper horizontal cross-member and two parallel side posts carrying the guidance means which cooperate with said at least two guidance ramps.

4. An apparatus according to claim 1, wherein said guide structure includes at least two guidance ramps and said at least two guidance ramps have respective shoulders for supporting the traveller and limiting the downward travel thereof when said submersible device is submerged in the liquid body while permitting the traveller to freely rise relative to said shoulders, and wherein the apparent weight of said traveller in the liquid body is greater than the product of the apparent weight of said submersible device multiplied by a factor n−1 where n is the number of strands formed by the suspension cable.

5. An apparatus according to claim 1, wherein said at least one ramp has means for temporarily connecting it to the traveller so as to maintain the traveller in a submerged position during the time that the submersible device is submerged.

6. An apparatus according to claim 1, wherein said at least one ramps includes at least one shoulder and said apparatus for handling further includes at least one submerged ballast resting on said at least one shoulder and adapted for upward slidable movement relative to said at least one shoulder, the traveller further having means for temporarily connecting it to said at least one submerged ballast during the time when the submersible device is submerged and wherein the apparent weight of the at least one ballast plus the apparent weight of the traveller exceeds n−1 times the apparent weight of the submersible device.

7. A method for handling a submersible device with an apparatus of the type including a control device mounted on a support structure and having a suspension cable with a free end at which said submersible device is suspended, a guide structure fixed to the support structure, traveller means, and a pulley block having said suspension cable wound thereabout so as to form n strands where n is greater than 1, wherein said pulley block and suspension cable are adapted to connect said traveller means to said guide structure, said method comprising the step of lowering said submersible device into a liquid body, said step of lowering including:

connecting said submersible device to said traveller means so as to form a first assembly when said submersible device is at least partly positioned out of said liquid body;

connecting said first assembly to said guide structure with said pulley block and suspension cable;

unwinding said suspension cable from a source thereof at a cable unwinding speed so as to lower said first assembly at a first slow speed equal to the cable unwinding speed divided by n, where n is the number of strands formed, until said submersible device is submerged in said liquid body;

detaching said submersible device from said traveller means; and further lowering said submersible device in said liquid body at said cable unwinding speed so as to eliminate the effect of said pulley block.

8. A method for handling a submersible device according to claim 7, further comprising the step of raising said submersible device out of the liquid body, said step of raising including:

raising said submersible device at a cable winding speed equal in magnitude and opposite in direction to said cable unwinding speed until said submersible device abuts against said traveller means, the latter being in a submerged condition as a result of said lowering step;

connecting said submersible device to said traveller means so as to form said first assembly;

raising said first assembly out of said liquid body at a slow speed equal to the cable winding speed divided by n.

* * * * *